US006837391B2

(12) United States Patent
Mino

(10) Patent No.: US 6,837,391 B2
(45) Date of Patent: Jan. 4, 2005

(54) SUSPENSION SYSTEM FOR BULK MATERIAL CARGO CONTAINER LINER

(75) Inventor: Oswaldo Mino, Houston, TX (US)

(73) Assignee: Illinois Tool Works Inc., Glenview, IL (US)

( * ) Notice: Subject to any disclaimer, the term of this patent is extended or adjusted under 35 U.S.C. 154(b) by 76 days.

(21) Appl. No.: 10/223,630

(22) Filed: Aug. 20, 2002

(65) Prior Publication Data

US 2004/0035864 A1 Feb. 26, 2004

(51) Int. Cl.[7] ..... B65D 88/00
(52) U.S. Cl. ..... 220/1.6; 383/22; 383/24
(58) Field of Search ..... 220/1.6; 383/22, 383/24, 7, 6

(56) References Cited

U.S. PATENT DOCUMENTS

| | | | | |
|---|---|---|---|---|
| 3,980,196 A | * | 9/1976 | Paulyson et al. | 220/1.5 |
| 4,124,136 A | * | 11/1978 | Bjelland et al. | 206/223 |
| 4,884,722 A | | 12/1989 | Podd | |
| 5,137,170 A | | 8/1992 | Matias | |
| 5,152,735 A | | 10/1992 | Podd, Jr. et al. | |
| 5,193,710 A | | 3/1993 | Podd, Sr. et al. | |
| 5,222,621 A | | 6/1993 | Matias | |
| 5,421,476 A | | 6/1995 | Matias | |
| 5,487,485 A | | 1/1996 | Yang et al. | |
| 5,489,037 A | | 2/1996 | Stopper | |
| 5,542,563 A | | 8/1996 | Matias | |
| 5,657,896 A | | 8/1997 | Matias | |

FOREIGN PATENT DOCUMENTS

| | | |
|---|---|---|
| EP | 0 274 417 | 7/1988 |
| FR | 2604160 | 3/1988 |
| GB | 2300178 | 10/1996 |

* cited by examiner

*Primary Examiner*—Joseph Man-Fu Moy
(74) *Attorney, Agent, or Firm*—Schwartz & Weinrieb

(57) ABSTRACT

A suspension system for a bulk material cargo container liner comprises a pair of vertically oriented suspension straps fixedly mounted upon opposite side, upper front nose corner regions of the bulk material cargo container liner. Each one of the suspension straps comprises a plurality of fastener grommets located predetermined distances beneath an upper edge portion of their respective suspension strap. In this manner, regardless of the elevational at which a bulk material cargo container liner support is fixedly disposed within a bulk material cargo container, the bulk material cargo container liner will be disposed at a proper elevational level within the bulk material cargo container so as to facilitate the proper inflation of the bulk material cargo container liner within the bulk material cargo container.

21 Claims, 1 Drawing Sheet

SUSPENSION SYSTEM FOR BULK MATERIAL CARGO CONTAINER LINER

FIELD OF THE INVENTION

The present invention relates generally to bulk material cargo containers within which fluid-like or flowable bulk materials, such as, for example, dry bulk chemicals, powdered and pelletized resins, flour, coffee beans, grain, and the like, are to be housed or contained while being shipped or transported, and more particularly to a new and improved bulk material cargo container liner, for use in conjunction with such bulk material cargo containers, wherein the new and improved bulk material cargo container liner exhibits a new and improved suspension system which enables the bulk material cargo container liner to be fully and properly suspended and expanded within any bulk material cargo container, regardless of the particular bulk material cargo container within which the bulk material cargo container liner is being employed, whereby the bulk material cargo container liner will be properly supported in its inflated state, within the bulk material cargo container, so as not to be subjected to forces which might otherwise tend to rupture the bulk material cargo container liner, and wherein further, the bulk material cargo container liner is appropriately reinforced so as to withstand bulk material cargo load unloading forces.

BACKGROUND OF THE INVENTION

Bulk material cargo containers are conventionally used, at different times, to house or contain different fluid-like or flowable bulk cargo materials, such as, for example, dry bulk chemicals, powdered and pelletized resins, flour, coffee beans, grains, rice, sugar, and the like, while the cargo materials are being shipped or transported from one location to another by means of, for example, bulk material cargo containers incorporated within a ship, truck, railroad train car, and the like. Since different materials are going to be shipped or transported within the bulk material cargo containers at different times, it is imperative that the bulk material cargo containers effectively be clean so as not to contaminate the bulk materials comprising a particular bulk material cargo load with residual bulk materials which may remain within the bulk material cargo container from a previously shipped or transported bulk material cargo load. Accordingly, in order to eliminate the necessary cleaning of each bulk material cargo container hold after a particular bulk material cargo load has been unloaded or discharged from a particular one of the bulk material cargo container holds, it has become conventional within the industry to employ removable bulk material cargo container liners within the cargo holds of the bulk material cargo containers wherein, after a particular bulk material cargo load is delivered to its destination and discharged or un-loaded, the bulk material cargo container liner is simply removed from the bulk material cargo container whereby the bulk material cargo container is again useable, without a significant amount of cleaning, for carrying another bulk material cargo load of fluid-like or flowable material. Examples of bulk container liners as used within bulk material cargo containers for shipping or transporting fluid-like or flowable materials may be found within U.S. Pat. No. 5,657,896 which issued on Aug. 19, 1997 to Matias, U.S. Pat. No. 5,542,563 which issued on Aug. 6, 1996 to Matias, U.S. Pat. No. 5,489,037 which issued on Feb. 6, 1996 to Stopper, U.S. Pat. No. 5,421,476 which issued on Jun. 6, 1995 to Matias, U.S. Pat. No. 5,222,621 which issued on Jun. 29, 1993 to Matias, U.S. Pat. No. 5,193,710 which issued on Mar. 16, 1993 to Podd, Sr. et al., U.S. Pat. No. 5,152,735 which issued on Oct. 6, 1992 to Podd, Jr. et al., U.S. Pat. No. 5,137,170 which issued on Aug. 11, 1992 to Matias, and U.S. Pat. No. 4,884,722 which issued on Dec. 5, 1989 to Podd.

While the noted removable bulk material cargo container liners have obviously performed satisfactorily from an overall point of view in connection with the achievement of their primary objectives as noted hereinbefore, such removable bulk material cargo container liners have exhibited several operational difficulties. For example, due to the various forces or loads which are normally impressed upon the bulk material cargo container liners during, for example, both the bulk material cargo loading operation, as well as the actual transportation or shipping period, the PRIOR ART liners have been subjected to tearing or rupture, as well as deterioration in connection with their proper support within the bulk material cargo container.

More particularly, as may best be appreciated from FIG. 1, the front or nose section of a conventional PRIOR ART bulk material cargo container liner is schematically illustrated and is generally indicated by the reference character 10. The bulk material cargo container liner 10 has a substantially rectangular parallelepiped configuration, and therefore it is apparent that the front or nose section of the bulk material cargo container liner 10 is defined by means of a front wall portion 12, a pair of side wall portions 14, only one of which is visible, a top wall portion 16, and a bottom wall portion, not illustrated. In order to suspendingly support the bulk material cargo container liner 10 within a bulk material cargo container, a double-sided strip of adhesive tape 18 is initially folded over upon itself so as to effectively trap therewithin a woven reinforcement strap, not shown. A pair of grommets 20 are also provided within the laterally spaced end portions of the adhesive tape-woven reinforcement strap assembly, and subsequently, the adhesive tape-woven reinforcement strap assembly is secured to the front or nose section of the bulk material cargo container liner 10 so as to extend horizontally across the bulk material cargo container liner 10 and thereby be able to overlap the upper front edge corner region 22 defined at the juncture of the front wall portion 12 and the top wall portion 16 whereby the adhesive tape-woven reinforcement strap assembly effectively straddles the front and top wall portions 12,16 of the bulk material cargo container liner 10.

In order to operatively connect the bulk material cargo container liner 10 to the interior of the bulk material cargo container, interior side wall portions of the bulk material cargo containers are conventionally provided with suitable support means known in the industry as finger-bars. A problem inherently characteristic of the use of such finger-bar support structures within the bulk material cargo containers, however, resides in the fact that the finger-bar support structures are not positioned at predetermined locations within the interiors of all bulk material cargo containers utilized within the industry. Sometimes, for example, the finger-bar support structures are located at an elevational level which is twelve inches (12.00") below the upper interior surface of the bulk material cargo container, however, at other times, the finger-bar support structures may be located at elevational levels which are, for example, twenty-two inches (22.00") below the upper interior surface of the bulk material cargo container or thirty-two inches (32.00") below the upper interior surface of the bulk material cargo container. Accordingly, when the bulk material cargo container liner 10 is to be secured to the interior of the bulk material cargo container by means of, for example, a plurality of hanger straps, belts, or ropes operatively associated with the grommets 20, installation personnel must in effect estimate or guess the amount of slack that must be provided within the support strapping, belting, or rope in order to permit the bulk material cargo container liner 10 to be properly suspended within the bulk material cargo container as well as subsequently disposed in its inflated condition or state.

Oftentimes, however, such guesses or estimates are incorrect whereby, for example, when the bulk material cargo container liner 10 is inflated, the upper front edge corner region 22 of the bulk material cargo container line 10 will not be properly mated with the upper front edge corner region of the bulk material cargo container. Accordingly, an air space will be defined between the upper front edge corner region 22 of the bulk material cargo container liner 10 and the upper front edge corner region of the bulk material cargo container whereby the various wall portions of the bulk material cargo container will not be able to effectively support the corresponding wall portions of the bulk material cargo container liner 10 which define the upper front edge corner region 22 of the bulk material cargo container liner 10. Consequently, such upper front edge corner region 22 of the bulk material cargo container liner 10 becomes susceptible to the inflation and bulk material cargo loading forces and pressures which tend to cause the bulk material cargo container liner 10 to experience or undergo rupture or failure. Additional failure of the bulk material cargo container liner 10 assembly can also occur as a result of the utilization of the double-sided adhesive tape 18, as the means for attaching the bulk material cargo container liner 10 to the finger-bar structures of the bulk material cargo container by the hanging straps, belts, ropes, or the like, in view of the fact that the adhesive properties of the adhesive tape 18 diminish over time as a result of prevailing or ambient temperature and humidity conditions present within the bulk material cargo container. Still further, the double-sided adhesive tape 18 is relatively expensive which renders the same economically undesirable.

A need therefore exists in the art for a new and improved bulk material cargo container liner, and in particular, for a suspension system operatively associated therewith, which will enable the bulk material cargo container liner to be operatively inflated and suspended within any bulk material cargo container, regardless of the particular disposition or elevational level of its finger-bar support 10 or suspension structure, so as to be capable of proper inflation and suspension of the bulk material cargo container liner within bulk material cargo containers whereby no air space or air bubble will be defined between the upper front edge corner region of the bulk material cargo container liner and the upper front edge corner region of the bulk material cargo container such that the bulk material cargo container liner can properly withstand or resist the inflation and cargo load forces or pressures so as to effectively exhibit enhanced tear or rupture resistance.

OBJECTS OF THE INVENTION

Accordingly, it is an object of the present invention to provide a new and improved suspension system for use in conjunction with a bulk material cargo container liner which is adapted to be disposed in an inflated state internally within a bulk material cargo container for holding bulk material cargo.

Another object of the present invention is to provide a new and improved suspension system, for use in conjunction with a bulk material cargo container liner which is adapted to be disposed within a bulk material cargo container, wherein the new and improved suspension system effectively overcomes the various operational disadvantages and drawbacks characteristic of conventional PRIOR ART suspension systems for bulk material cargo container liners.

An additional object of the present invention is to provide a new and improved suspension system, for use in conjunction with a bulk material cargo container liner which is adapted to be disposed within a bulk material cargo container, wherein the new and improved suspension system enables the bulk material cargo container liner to be fully and properly suspended and expanded within any bulk material cargo container regardless of the particular bulk material cargo container within which the bulk material cargo container liner is being employed.

A further object of the present invention is to provide a new and improved suspension system, for use in conjunction with a bulk material cargo container liner which is adapted to be disposed within a bulk material cargo container, wherein the new and improved suspension system enables the bulk material cargo container liner to be fully and properly suspended and expanded within any bulk material cargo container, regardless of the particular bulk material cargo container within which the bulk material cargo container liner is being employed, whereby the bulk material cargo container liner will be properly supported in its inflated state within the bulk material cargo container so as not to be subjected to forces which might otherwise tend to rupture the bulk material cargo container liner.

A last object of the present invention is to provide a new and improved suspension system, for use in conjunction with a bulk material cargo container liner which is adapted to be disposed within a bulk material cargo container, wherein the new and improved suspension system enables the bulk material cargo container liner to be fully and properly suspended and expanded within any bulk material cargo container, regardless of the particular bulk material cargo container within which the bulk material cargo container liner is being employed, whereby the bulk material cargo container liner will be properly supported in its inflated state within the bulk material cargo container so as not to be subjected to inflation and loading pressure forces which might otherwise tend to rupture the bulk material cargo container liner, and wherein further, the bulk material cargo container liner is appropriately reinforced so as to withstand bulk material cargo load unloading forces so as to effectively exhibit enhanced tear or rupture resistance.

SUMMARY OF THE INVENTION

The foregoing and other objectives are achieved in accordance with the teachings and principles of the present invention through the provision of a new and improved suspension system for use in conjunction with a bulk material cargo container liner which is adapted to be disposed within a bulk material cargo container, wherein the new and improved suspension system comprises a pair of three-ply polyethylene laminated suspension straps each of which is adapted to be folded in half upon itself so as to effectively entrap therewithin a woven reinforcing strip fabricated from polypropylene. The reinforced suspension straps are adapted to be fixedly secured to the upper corner regions of the nose section of the bulk material cargo container liner such that the reinforced suspension straps are oriented vertically, and five reinforcing grommets are fixedly mounted at predetermined locations within each one of the reinforced suspension straps. In particular, the second, third, and fourth grommets are respectively located at positions which are twelve inches (12.00"), twenty-two inches (22.00"), and thirty-two inches (32.00") from the upper end of each one of the suspension straps and are adapted to have a snap-hook fastener passed through one of the grommets so as to respectively facilitate the connection of each one of the suspension straps, and thus the upper corner regions of the bulk material cargo container liner, to one of a plurality of finger bars fixedly provided upon the interior wall portions of the bulk material cargo container.

More particularly, since the plurality of finger bars are conventionally mounted upon the interior wall portions of the bulk material cargo container at positions which are respectively located twelve inches (12.00"), twenty-two inches (22.00"), and thirty-two inches (32.00") from the upper front end corner regions of the bulk material cargo container, and since the second, third, and fourth grommets are respectively provided within the suspension straps at positions which are likewise located twelve inches (12.00"), twenty-two inches (22.00"), and thirty-two inches (32.00") from the upper end of each one of the suspension straps when the bulk material cargo container is properly and fully inflated, then when a snap-hook fastener is passed through the particular one of the grommets which effectively matches the particular location of the finger bar within the particular bulk material cargo container so as to effectively connect each one of the suspension straps to a respective one of the bulk material cargo container finger bars, the bulk material cargo container liner will be automatically or inherently disposed at a proper elevational position within the interior of the bulk material cargo container so as to be able to be disposed in its properly inflated state relative or with respect to the interior wall portions of the bulk material cargo container when the bulk material cargo container undergoes inflation.

In this manner, no air space or air bubble will be present between the upper corner region of the bulk material cargo container liner and the up-per interior front end corner region of the bulk material cargo container such that the various wall and seam portions of the bulk material cargo container liner can be properly supported by means of the interior wall portions of the bulk material cargo container. Accordingly, the bulk material cargo container liner is capable of readily withstanding or resisting inflation and cargo load forces or pressures so as to effectively exhibit enhanced tear or rupture resistance so as not to be susceptible to, undergo, or experience rupture, failure, and leakage which would effectively negate the objective of utilizing bulk material cargo container liners within bulk material cargo containers.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 2:
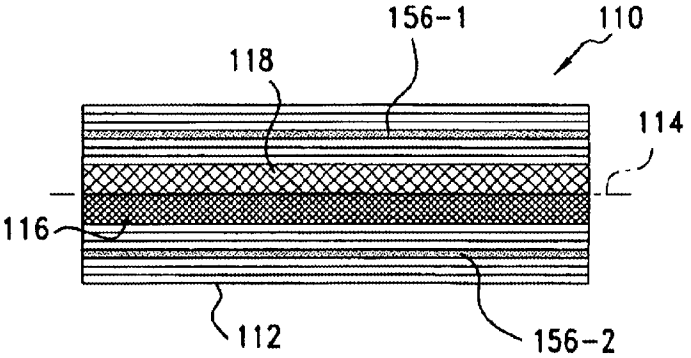
FIG. 2 is a top plan view of a new and improved suspension strap constructed in accordance with the principles and teachings of the present invention and comprising a three-ply laminate disposed in its unfolded state with a woven reinforcement strip being fixedly disposed therein.
Figure 1:
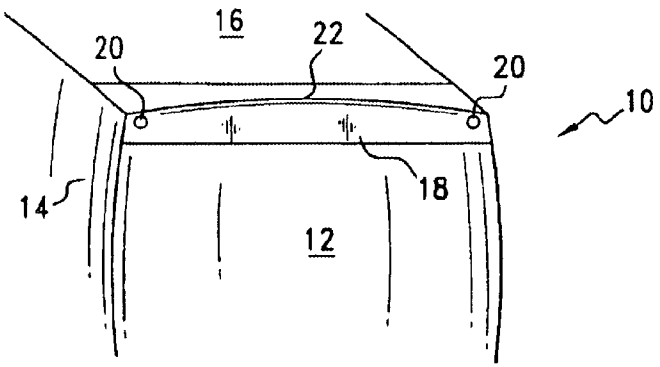
FIG.1 (PRIOR ART)
FIG. 1 is a front perspective view of a nose section of a bulk material cargo container liner showing a conventional PRIOR ART suspension system used for suspending a bulk material container liner from finger bar structure fixedly disposed upon internal wall portions of a bulk material cargo container.
Figure 3:
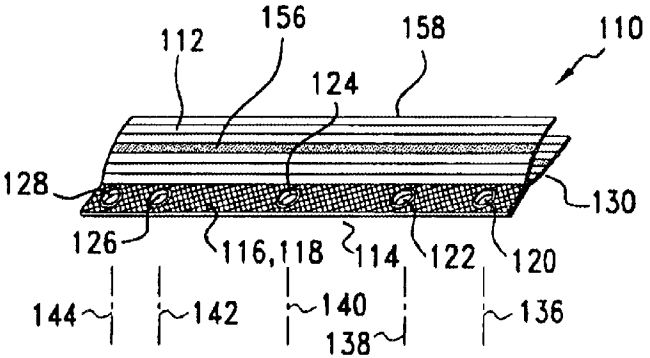
FIG. 3 is a perspective view of the new and improved suspension strap as disclosed within FIG. 2 showing the suspension strap in its folded state entrapping the reinforcing strip therewithin and having a plurality of grommets fixedly secured within the reinforced suspension strap at predetermined locations along the longitudinal extent thereof.

Referring now to the drawings, and more particularly to FIGS. 2 and 3 thereof, a new and improved suspension strap, constructed in accordance with the principles and teachings of the present invention for use upon a bulk material cargo container liner in order to suspendingly support the bulk material cargo container liner upon finger bars fixedly mounted upon internal wall portions of a bulk material cargo container, is disclosed and is generally indicated by the reference character 110. More particularly, the new and improved suspension strap 110 is seen to comprise a three-ply base laminate 112 which is preferably fabricated from a suitable plastic material, such as, for example, a cross-laminated, ultra-violet stabilized polyethylene, and it is seen further that the base laminate 112 has a longitudinal extent or length dimension of thirty-six inches (36.00") and a lateral extent or width dimension of ten inches (10.00"). The base laminate 112 is adapted to be folded over upon itself along the longitudinally extending center line or mid-line 114 thereof, and a woven reinforcing strip 116, similar to a conventional automotive seat belt and fabricated from a suitable plastic material, such as, for example, polypropylene, is adapted to be fixedly secured upon a central region of the interior surface portion of the base laminate 112 such that, for example, the upper edge portion of the reinforcing strip 116 is disposed along the longitudinal center line or mid-line 114 of the base laminate 112.

The reinforcing strip 116 has a longitudinal extent or length dimension of thirty-six inches (36.00") and a lateral extent or width dimension of two inches (2.00"), and in order to fixedly secure the reinforcing strip 116 upon the interior surface portion of the base laminate 112 such that the reinforcing strip 116 will be entrapped within the base laminate 112 when the base laminate 112 is folded over upon itself along the longitudinal center line or mid-line 114 thereof, a suitable adhesive 118 is disposed or deposited upon the central region of the interior surface portion of the base laminate 112 so as to effectively straddle, or be disposed upon opposite sides of, the longitudinal center line or mid-line 114 of the base laminate 112. In particular, the central region of the base laminate 112, upon which the adhesive material 118 is disposed or deposited, has a longitudinal extent or length dimension of thirty-six inches (36.00") and a lateral extent or width dimension of four inches (4.00"). In this manner, when the reinforcing strip 116 is fixedly disposed upon the base laminate 112 as disclosed within FIG. 2, and when the base laminate 112 is folded over upon itself along the longitudinal center line or mid-line 114 thereof, the opposite side surfaces of the reinforcing strip 116 will be adhesively bonded to the oppositely disposed interior surface portions of the base laminate 112.

Figure 4:
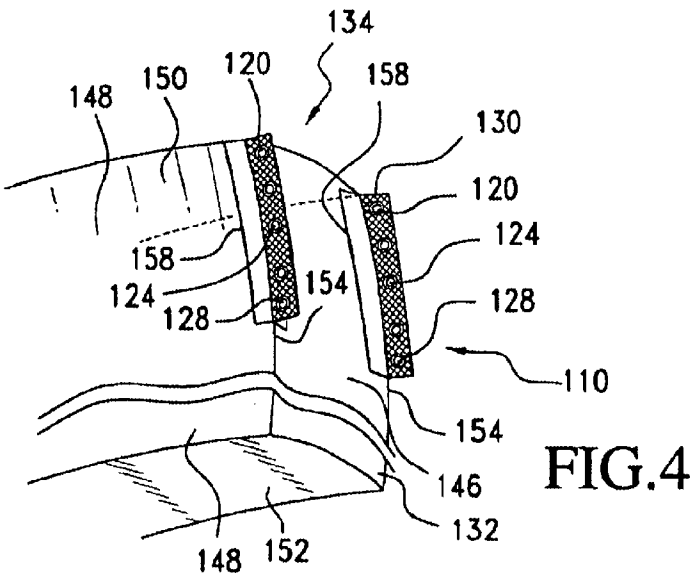
FIG. 4 is a side perspective view of a new and improved bulk material cargo container liner constructed in accordance with the principles and teachings of the present invention and having a pair of suspension straps, as disclosed within FIGS. 2 and 3, fixedly mounted upon the upper side corner regions thereof.

With reference now being additionally made to FIGS. 3 and 4, after the base laminate 112 has been folded over upon itself along the longitudinal center line or midline 114 such that the reinforcing strip 116 is now securely adhesively bonded internally within the base laminate 112, a plurality of snap-hook fastener grommets 120,122,124,126,128 are fixedly mounted within that portion of the bulk material cargo container liner suspension strap 110 which was formerly the central region of the base laminate 112, and which has the reinforcement strip 116 adhesively bonded therein, such that the snap-hook fastener grommets 120–128 extend through the mated halves of the base laminate 112 as well as through the reinforcement strip 116 interposed between the mated halves of the base laminate 112. More particularly, it is noted that in accordance with the unique and novel principles and teachings of the present invention, the plurality of snap-hook fastener grommets 120–128 are located at particular predetermined positions with respect to the right edge portion 130 of the bulk material cargo container liner suspension strap 110, as disclosed within FIG. 3, which corresponds to the upper edge portion of the bulk material cargo container liner suspension strap 110 when each one of the bulk material cargo container liner suspension straps 110 is actually fixedly secured to and mounted upon the nose section 132 of a bulk material cargo container liner 134, as disclosed within FIG. 4.

More specifically, the plurality of snap-hook fastener grommets 120–128, mounted within each one of the suspension straps 110, are respectively located at first, second, third, fourth, and fifth positions 136,138,140,142,144 wherein the first position 136, at which the first grommet 120 is fixedly disposed, is spaced one and one-half inches (1.50") from the right or upper edge portion 130 of each suspension strap 110, the second position 138, at which the second grommet 122 is fixedly disposed, is spaced ten and one-half inches (10.50") from the first position 136, the third position 140, at which the third grommet 124 is fixedly disposed, is spaced ten inches (10.00") from the second position 138, the fourth position 142, at which the fourth grommet 126 is fixedly disposed, is similarly spaced ten inches (10.00") from the third position 140, and lastly, the fifth position 144, at which the fifth grommet 128 is fixedly disposed, is spaced two and one-half inches (2.50") from the fourth position 142 and one and one-half inches (1.50") from the left or lower edge portion 131 of each suspension strap 110. In this manner, it can be readily appreciated further that the second, third, and fourth snap-hook fastener grommets 122,124,126 are located at their corresponding second, third, and fourth positions 138,140,142 which are respectively spaced twelve inches (12.00"), twenty-two inches (22.00"), and thirty-two inches (32.00") from the right or upper edge portion 130 of each bulk material cargo container liner suspension strap 110. As disclosed within FIG. 4, the nose section 132 of the bulk material cargo container liner 134 is seen to comprise, for example, a front wall portion 146, a pair of oppositely disposed side wall portions 148,148, an upper or top wall portion 150, and a lower or bottom wall portion 152. Accordingly, it can be readily appreciated still further that when each one of the bulk material cargo container liner suspension straps 110 is fixedly secured to the nose section 132 of the bulk material cargo container liner 134, as disclosed within FIG. 4, wherein each one of the bulk material cargo container liner suspension straps 110 will have its longitudinal extent oriented vertically, the second, third, and fourth snap-hook fastener grommets 122, 124,126 will be located at their corresponding second, third, and fourth positions 138,140,142 which will be respectively spaced twelve inches (12.00"), twenty-two inches (22.00"), and thirty-two inches (32.00") beneath the upper edge portion 130 of each bulk material cargo container liner suspension strap 110 as well as beneath the upper or top wall portion 150 of the bulk material cargo container liner 134 when the bulk material cargo container liner 134 is disposed in its inflated state.

It is to be recalled, as has been noted hereinbefore, that it is conventional within the bulk material cargo container industry that the internal side wall portions of bulk material cargo containers are provided with finger bars upon or to which bulk material cargo container liner suspension straps can be suspendingly secured. In addition, it is also to be recalled, depending upon the particular bulk material cargo container and the manufacturer thereof, that the finger bars are disposed at positions which are located either at a distance of twelve inches (12.00"), twenty-two inches (22.00"), or thirty-two inches (32.00") beneath the upper internal front corner regions of the bulk material cargo container. Accordingly, when it is desired to insert or deploy a particular bulk material cargo container liner 134 within a particular bulk material cargo container, it is desirable to secure the nose section 132 of the bulk material cargo container liner 134 internally within the bulk material cargo container as a result of disposing a snap-hook fastener within the particular one of the snap-hook fastener grommets 122,124,126 which is located at the predetermined distance from or beneath the upper edge portion 130 of each bulk material cargo container liner suspension strap 110 which corresponds to or matches the predetermined distance that the particular finger bar of the particular bulk material cargo container, within which the bulk material cargo container liner 134 is being disposed, is located from or beneath the upper wall portions or upper front corner region of the particular bulk material cargo container.

In this manner, when the bulk material cargo container liner 134 is fully inflated, the upper front corner region of the bulk material cargo container liner 134, as defined by means of the upper wall portion 150, and the upper regions of the side wall portions 148,148 and the front wall portion 146, will be properly disposed with respect to the corresponding upper internal wall portions of the bulk material cargo container. Accordingly, when the bulk material cargo container liner 134 is disposed in its fully inflated state, an air space or bubble will not be formed or defined between the upper region of the nose section 132 of the bulk material cargo container liner 134 and the upper internal wall portions or the upper front corner region of the particular bulk material cargo container. Accordingly, as a result of this structural interaction effectively defined between the upper front section of the bulk material cargo container liner nose section 132 and the upper internal wall portions of the bulk material cargo container, the upper region of the nose section 132 of the bulk material cargo container liner 134 will be properly supported by means of the aforenoted upper internal wall portions or upper front corner region of the bulk material cargo container such that excessive forces and pressures, normally or conventionally characteristic of or experienced by the bulk material cargo container liners as a result of the inflation and loading of the same, will no longer be present so as not to potentially result in failures, ruptures, and leakage of bulk material cargo container liner 134.

As can be further appreciated from FIGS. 2–4, when the bulk material cargo container liner suspension straps 110 are to be secured to the upper corner regions of the nose section 132 of the bulk material cargo container liner 134 as can best be appreciated from FIG. 4, the bulk material cargo container liner suspension straps 110, which have been previously folded in half upon themselves as disclosed within FIG. 3, are adapted to be heat-sealed to opposite sides of the nose section 132 of the bulk material cargo container liner 134 and at the upper front corner regions thereof. More particularly, each one of the bulk material cargo container liner suspension straps 110 is adapted to be heat-sealed along upper seam corner portions 154 of the nose section 132 of the bulk material cargo container liner 134 which are respectively defined between each one of the side wall portions 148,148 and the front wall portion 146 thereof. In accordance with the heat-sealing of the bulk material cargo container liner suspension straps 110 to the upper seam corner portions 154 of the nose section 132 of the bulk material cargo container liner 134, it is additionally seen that each one of the bulk material cargo container liner suspension straps 110 is adapted to be heat-sealed to the nose section 132 of the bulk material cargo container liner 134 along a locus 156 which extends longitudinally throughout the vertical extent of each bulk material cargo container liner suspension strap 110 and which is located approximately half way between the location of the reinforcing strip 116 and the free edge portion 158 of the folded bulk material cargo container liner suspension strap 110 which is disposed opposite the longitudinal center line or mid-line 114 of the bulk material cargo container liner suspension strap 110.

The heat-seal locus 156 is schematically illustrated in FIG. 3 simply as a means for showing its disposition with respect to the other structural components of each bulk material cargo container liner suspension strap 110, and similarly, the heat seal locus 156 has been schematically illustrated in FIG. 2 as components 156-1 and 156-2 simply as a means for showing how the locations, at which the heat-seal regions will be subsequently formed, will effectively be brought together when the opposite sides of the laminate 112 of each bulk material cargo container liner suspension strap 110 are folded together upon themselves. It is to be noted or emphasized, however, that the heat-sealing operation is only performed in connection with the attachment of each bulk material cargo container liner suspension strap 110 to the opposite upper side edge seam portions 154 of the nose section 132 of the bulk material cargo container liner 134 and not in connection with the folding over of the laminate 112 upon itself.

As has been previously noted, in connection with the fixation of each bulk material cargo container liner suspension strap 110 to a particular one of the finger bars of the bulk material cargo container, a snap-hook fastener is adapted to be inserted within the particular one of the second, third, or fourth snap-hook fastener grommets 122, 124, or 126 which is located at an elevational level which corresponds to or matches the elevational level at which the finger bar of the particular bulk material cargo container is located so as to properly fixedly secure the nose section 132 of the bulk material cargo container liner 134 within the bulk material cargo container, however, the first and fifth snap-hook fastener grommets 120,128 are not actually adapted or intended to receive a snap-hook fastener in connection with the suspension of the bulk material cargo container liner 134 within the bulk material cargo container. More particularly, the first and fifth snap-hook fastener grommets 120,128 are provided as a means of enhancing the reinforcement characteristics of each bulk material cargo container liner suspension strap 110 in connection with the suspension forces acting upon each one of the bulk material cargo container liner suspension straps 110, or to which each one of the bulk material cargo container liner suspension straps 110 is subjected, as a result of being suspended within the bulk material cargo container, particularly during cargo load unloading procedures when the bulk material cargo container, and the liner disposed therein, are subjected to or undergo tilting or inclining movements.

More specifically, when a snap-hook fastener is disposed within the central or third one of the snap-hook fastener grommets 124 and the suspension forces are subsequently impressed upon the particular bulk material cargo container liner suspension strap 110, any such forces, which would otherwise tend to tear or rupture the bulk material cargo container liner suspension strap 110, will be effectively resisted by means of the adhesively bonded assembly defined by means of the three-ply laminate 112, the reinforcing strip 116, and the other snap-hook fastener grommets 120,122 and 126,128 disposed upon opposite sides of the central or third snap-hook fastener grommet 124. In a similar manner, when a snap-hook fastener is disposed within the second one of the snap-hook fastener grommets 122 and the suspension forces are subsequently impressed upon the particular bulk material cargo container liner suspension strap 110, any such forces, which would otherwise tend to tear or rupture the bulk material cargo container liner suspension strap 110, will be effectively resisted by means of the adhesively bonded assembly defined by means of the three-ply laminate 112, the reinforcing strip 116, and the other snap-hook fastener grommets, particularly the first and third grommets 124 and 120, disposed upon opposite sides of the second snap-hook fastener grommet 122. Similar force resistance, and rupture prevention, characteristics will likewise be operative in connection with the mounting of a snap-hook fastener within the fourth snap-hook fastener grommet 126.

Thus, it may be seen that in accordance with the principles and teachings of the present invention, there has been provided a new and improved bulk material cargo container liner suspension strap, for use in connection with the mounting of bulk material cargo container liners within bulk material cargo containers, wherein a plurality of snap-hook fastener grommets are provided within the bulk material cargo container liner suspension strap along a vertically oriented array, and wherein further each one of the snap-hook fastener grommets is located at a location which is spaced a predetermined distance from the upper surface portion of the bulk material cargo container liner such that when the latter is disposed in its fully inflated state, the upper corner region of the nose section of the bulk material cargo container liner will be properly disposed with respect to the upper front internal regions of the bulk material cargo container. In this manner, the internal wall portions of the upper front internal regions of the bulk material cargo container can properly support the upper corner region of the nose section of the bulk material cargo container liner such that the latter does not experience excessive forces or pressures which would otherwise lead to failure or rupture of the same whereby the bulk material cargo contents would leak from the bulk material cargo container. In addition, the bulk material cargo container liner suspension straps are specially reinforced so as to effectively resist forces attendant cargo load unloading forces which will be impressed upon the bulk material cargo container liner as a result of tilting or inclining of the same.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by letters patent of the United States of America, is:

1. A suspension strap, for use upon a bulk material cargo container liner in order to properly support the bulk mater-ial cargo container liner at any one of a plurality of predetermined elevational levels within a bulk material cargo container so as to match the elevational level at which a bulk material cargo container liner support is fixedly disposed within a bulk material cargo container, comprising:

an elongated suspension strap;

means for fixedly securing said elongated suspension strap within an upper corner region of a bulk material cargo container liner such that said elongated suspension strap will be oriented vertically and will have an upper edge portion; and at least three fastener grommets, fixedly mounted within said vertically oriented suspension strap so as to be disposed along a predetermined vertical array wherein said at least three fastener grommets are respectively located at a first predetermined distance of twelve inches (12.00"), a second predetermined distance of twenty-two inches (22.00"), and a third predetermined distance of thirty-two inches (32.00") beneath said upper edge portion of said vertically oriented suspension strap, for attaching a predetermined one of said at least three fastener grommets to a bulk material cargo container liner support fixedly disposed within a bulk material cargo container, whereby regardless of the elevational level, comprising twelve inches (12.00"), twenty-two inches (22.00"), and thirty-two inches (32.00") beneath the upper wall portion of the bulk material cargo container at which the bulk material cargo container liner support is fixedly disposed within the bulk material cargo container, the bulk material cargo container liner can be adjustably positioned with respect to the bulk material cargo container liner support disposed within the bulk material cargo container by operatively mating said predetermined one of said at least three fastener grommets with the bulk material cargo container liner support such that the bulk material cargo container liner will be disposed at a proper elevational level within the bulk material cargo container so as to facilitate the proper inflation of the bulk material cargo container liner within the bulk material cargo container.

2. The suspension strap as set forth in claim 1 wherein:

said vertically oriented suspension strap comprises a three-ply laminate.

3. The suspension strap as set forth in claim 2, wherein:

said three-ply laminate comprises polyethylene.

4. The suspension strap as set forth in claim 1, further comprising:

a reinforcing strip fixedly mounted upon said vertically oriented suspension strap.

5. The suspension strap as set forth in claim 4, wherein:

said vertically oriented suspension strap is folded over upon itself; and said reinforcing strip is fixedly secured interiorly of said folded over vertically oriented suspension strap.

6. The suspension strap as set forth in claim 5, wherein:

said reinforcing strip is fabricated from woven polypropylene.

7. The suspension strap as set forth in claim 4, wherein:

said at least three fastener grommets fixedly mounted within said vertically oriented suspension strap are also fixedly mounted within said reinforcing strip.

8. The suspension strap as set forth in claim 1, wherein:

said at least three fastener grommets comprises five fastener grommets wherein a fourth fastener grommet is fixedly mounted within said vertically oriented suspension strap at a location which is above said first fastener grommet, and a fifth fastener grommet is fixedly mounted within said vertically oriented suspension strap at a location which is beneath said third fastener grommet such that when the fastener, for attaching a predetermined one of said at least three fastener grommets to the bulk material cargo container liner support fixedly disposed within the bulk material cargo container, is passed through said predetermined one of said at least three fastener grommets, at least two fastener grommets are disposed upon opposite sides of said predetermined one of said at least three fastener grommets, which is fastened to the bulk material cargo container liner support fixedly disposed within the bulk material cargo container by the fastener passed through said predetermined one of said at least three fastener grommets, so as to reinforce the suspension loads impressed upon said predetermined one of said at least three fastener grommets as a result of said predetermined one of said at least three fastener grommets being attached to the bulk material cargo container liner support, fixedly disposed within the bulk material cargo container, by the fastener passed through said predetermined one of said at least three fastener grommets.

9. A suspension system, in combination with a bulk material cargo container liner, in order to properly support said bulk material cargo container liner at any one of a plurality of predetermined elevational levels within a bulk material cargo container so as to match the elevational level at which a bulk material cargo container liner support is fixedly disposed within a bulk material cargo container, comprising:

a bulk material cargo container liner;

at least one vertically oriented suspension strap fixedly secured within an upper corner region of said bulk material cargo container liner; and a plurality of fastener grommets, fixedly mounted within said at least vertically oriented suspension strap so as to be disposed along a predetermined vertical array wherein said plurality of fastener grommets are vertically spaced from each other by means of predetermined distances, for attaching a predetermined one of said plurality of fastener grommets to a bulk material cargo container liner support fixedly disposed within a bulk material cargo container, whereby regardless of the elevational level at which the bulk material cargo container liner support is fixedly disposed within the bulk material cargo container, said bulk material cargo container liner can be adjustably positioned with respect to the bulk material cargo container liner support disposed within the bulk material cargo container by operatively mating said predetermined one of said plurality of fastener grommets with the bulk material cargo container liner support such that the bulk material cargo container liner will be disposed at a proper elevational level within the bulk material cargo container so as to facilitate the proper inflation of said bulk material cargo container liner within the bulk material cargo container.

10. The suspension system as set forth in claim 9, wherein:

said at least one vertically oriented suspension strap comprises a three-ply laminate.

11. The suspension system as set forth in claim 10 wherein:

said three-ply laminate comprises polyethylene.

12. The suspension system as set forth in claim 9, further comprising:

a reinforcing strip fixedly mounted upon said vertically oriented suspension strap.

13. The suspension system as set forth in claim 12, wherein:

said vertically oriented suspension strap is folded over upon itself; and said reinforcing strip is fixedly secured interiorly of said folded over vertically oriented suspension strap.

14. The suspension system as set forth in claim 13, wherein:

said reinforcing strip is fabricated from woven polypropylene.

15. The suspension system as set forth in claim wherein:

said plurality of fastener grommets fixedly mounted within said vertically oriented suspension strap are also fixedly mounted within said reinforcing strip.

16. The suspension system as set forth in claim 9, wherein:

said plurality of fastener grommets fixedly mounted within said vertically oriented suspension strap comprise at least three fastener grommets.

17. The suspension system as set forth in claim 16, wherein:

said vertically oriented suspension strap comprises an upper edge portion; and said at least three fastener grommets are respectively located at a first predetermined distance of twelve inches (12.00"), a second predetermined distance of twenty-two inches (22.00"), and a third predetermined distance of thirty-two inches (32.00") beneath said upper edge portion of said vertically oriented suspension strap, whereby regardless of the elevational level, comprising twelve inches (12.00"), twenty-two inches (22.00"), and thirty-two inches (32.00") beneath the upper wall portion of the bulk material cargo container at which the bulk material cargo container liner support is fixedly disposed, said bulk material cargo container liner will be disposed at a proper elevational level within the bulk material cargo container so as to facilitate the proper inflation of said bulk material cargo container liner within the bulk material cargo container.

18. The suspension system as set forth in claim 17, wherein:

said at least three fastener grommets comprises five fastener grommets wherein a fourth fastener grommet is fixedly mounted within said vertically oriented suspension strap at a location which is above said first fastener grommet, and a fifth fastener grommet is fixedly mounted within said vertically oriented suspension strap at a location which is beneath said third fastener grommet such that when the fastener, for attaching a predetermined one of said at least three fastener grommets to the bulk material cargo container liner support fixedly disposed within the bulk material cargo container, is passed through said predeter-mined one of said at least three fastener grommets, at least two fastener grommets are disposed upon opposite sides of said predetermined one of said at least three fastener grom-mets, which is fastened to the bulk material cargo container liner support fixedly disposed within the bulk material car-go container by the fastener passed through said predeter-mined one of said at least three fastener grommets, so as to reinforce the suspension loads impressed upon said predetermined one of said at least three fastener grommets as a result of said predetermined one of said at least three fastener grommets being attached to the bulk material cargo container liner support, fixedly disposed within the bulk material cargo container, by the fastener passed through said predetermined one of said at least three fastener grom-mets.

19. The suspension system as set forth in claim 9, wherein:

said at least one vertically oriented suspension strap fixedly secured to said bulk material cargo container liner comprises a pair of vertically oriented suspension straps.

20. The suspension system as set forth in claim 19, wherein:

said pair of vertically oriented suspension straps are fixedly mounted to opposite side, upper front nose corner regions of said bulk material cargo container liner.

21. The suspension system as set forth in claim 20, wherein:

said pair of vertically oriented suspension straps are heat-sealed to said upper front nose corner regions of said bulk material cargo container liner.

* * * * *